US007261342B2

(12) United States Patent
Smith

(10) Patent No.: US 7,261,342 B2
(45) Date of Patent: Aug. 28, 2007

(54) AUTOMATICALLY LOCKING WINDOW LATCH

(76) Inventor: Richard B. Smith, 3991 Lares Way, Salt Lake City, UT (US) 84124

( * ) Notice: Subject to any disclaimer, the term of this patent is extended or adjusted under 35 U.S.C. 154(b) by 63 days.

(21) Appl. No.: 10/819,855

(22) Filed: Apr. 7, 2004

(65) Prior Publication Data

US 2004/0201227 A1 Oct. 14, 2004

Related U.S. Application Data

(60) Provisional application No. 60/461,064, filed on Apr. 8, 2003.

(51) Int. Cl.
*E05B 63/24* (2006.01)
*E05C 19/00* (2006.01)

(52) U.S. Cl. ..... 292/332; 292/137; 292/302; 292/333; 292/DIG. 20; 292/DIG. 47

(58) Field of Classification Search ..... 292/332–336, 292/2, 32, 33, 41, 49, 137, 163, 174, 302, 292/303, DIG. 20, DIG. 47, 150, 175, 241, 292/DIG. 53, DIG. 64; 16/413, 422, DIG. 24, 16/DIG. 40; 70/89, 90
See application file for complete search history.

(56) References Cited

U.S. PATENT DOCUMENTS 156,860 A * 11/1874 Ruscoe et al. ..... 292/207
254,232 A * 2/1882 Orton ..... 292/332
351,575 A * 10/1886 Case ..... 292/335
524,146 A * 8/1894 Hottes ..... 292/175
832,731 A * 10/1906 James ..... 292/244
835,333 A 11/1906 Tauveron
849,800 A * 4/1907 Lowthorp ..... 292/244
880,265 A * 2/1908 Anderson ..... 292/4
919,750 A * 4/1909 Neumeister ..... 292/60
1,073,057 A * 9/1913 Schmid ..... 292/99
1,090,305 A * 3/1914 Hoffman ..... 70/100
1,141,286 A * 6/1915 Takacs ..... 292/335
1,180,943 A * 4/1916 Prazmo ..... 292/163
1,198,509 A * 9/1916 Anderson ..... 292/179
1,253,810 A * 1/1918 Gianninoto ..... 292/207
1,617,813 A * 2/1927 Judge ..... 292/150
1,619,031 A * 3/1927 Ostrosky et al. ..... 292/240
1,816,134 A * 7/1931 Wood ..... 292/333
2,480,016 A * 8/1949 Granberg ..... 292/336
2,645,515 A * 7/1953 Thomas, Sr. ..... 292/336

(Continued)

*Primary Examiner*—Carlos Lugo
(74) *Attorney, Agent, or Firm*—Kunzler & McKenzie

(57) ABSTRACT

An automatic locking window latch including a housing for holding a handle with a fully integrated bolt for securing a window, and a catch for engaging the window to release the bolt to secure the window, as well as to hold the bolt open to open the window. The catch may include a catch body, a spring guide, and a trigger pin. The spring guide slideably fits over a post attached to the housing for guiding the catch body and positioning a catch spring. In an unlocked position, an external force acting against the trigger pin causes the catch body to slide from between the bolt and a slide surface of the housing along the post. As the catch body moves past the bolt, bolt springs push bolt extensions of the bolt through the housing and into an adjoining window molding to secure the window. The catch spring presses the catch body against the bolt until the handle pulls the bolt from the locked position.

14 Claims, 9 Drawing Sheets

U.S. PATENT DOCUMENTS 2,714,030 A * 7/1955 Gardner ..... 292/178
2,733,093 A * 1/1956 Reitzel ..... 292/332
2,884,276 A * 4/1959 Baptist ..... 292/336
3,077,359 A * 2/1963 Ettore et al. ..... 292/3
3,082,617 A 3/1963 Kerman ..... 70/90
3,216,756 A * 11/1965 Ahlgren ..... 292/169.15
3,330,585 A * 7/1967 Pollin ..... 292/164
3,621,686 A * 11/1971 Klein ..... 70/157
3,768,847 A 10/1973 Buck, Jr. et al. ..... 292/179
3,984,136 A 10/1976 Bills ..... 292/182
4,179,143 A * 12/1979 Shy ..... 292/179
4,239,268 A * 12/1980 Rider ..... 292/5
4,293,154 A 10/1981 Cassells ..... 292/144
4,565,078 A 1/1986 Solomon ..... 70/95
4,699,406 A 10/1987 Swanson, Jr. ..... 292/175
4,746,152 A * 5/1988 Willcox ..... 292/150
4,840,050 A * 6/1989 Gotanda ..... 70/107
4,854,619 A * 8/1989 Nakauchi ..... 292/335
4,997,218 A * 3/1991 Culling ..... 292/60
5,326,141 A 7/1994 Gorman ..... 292/66
5,457,976 A * 10/1995 Stillwagon ..... 70/456 R
5,524,944 A * 6/1996 Berg ..... 292/163
D371,290 S 7/1996 Ozark ..... D8/307
D380,957 S * 7/1997 Evans et al. ..... D8/337
5,669,639 A 9/1997 Lawrence ..... 292/175
6,045,169 A * 4/2000 Frolov ..... 292/332
6,485,070 B1 11/2002 Schultz ..... 292/175
6,634,683 B1 * 10/2003 Brannan ..... 292/241
7,013,603 B2 * 3/2006 Eenigenburg et al. ..... 49/185
7,063,361 B1 * 6/2006 Lawrence ..... 292/241
2003/0024168 A1 2/2003 Mitchell et al. ..... 49/449

* cited by examiner

AUTOMATICALLY LOCKING WINDOW LATCH

CROSS-REFERENCES TO RELATED APPLICATIONS

This application claims priority to U.S. Provisional Patent Application No. 60/461,064 entitled "Automatically Locking Window Latch" and filed on Apr. 8, 2003 for Richard B. Smith, which is incorporated herein by reference.

BACKGROUND OF THE INVENTION

1. Field of the Invention

This invention relates in general to window latches. Specifically, the present invention relates to an automatically locking window latch for use with any window with an operable sash.

2. Description of the Related Art

In any type of establishment where security is a concern, it is important to equip the establishment with locking windows. In fact, window latches are well known in the industry, but difficulty lies in producing a window latch that provides adequate assurance of safety, durability, ease of use, and aesthetic appeal.

Typically, current window latches comprise an extendible bolt or a rotatable cam mounted on an inner window that fits into a slot or receiver on an outer window in order to secure a pair of windows together. However, such latch designs suffer from many distinct limitations. First, one must remember to physically close the latch each time the windows are closed in order to be certain that a window is secured. Second, in certain designs, if the window is moved while the latch is extended or in a locked position, the latch can scratch the frame of the window or the glass. Third, if the window rails become dirty, expand from moisture, or if the window is not closed completely before the latch is activated to secure the window, the window may become further damaged and the window may remain unlocked. Fourth, in certain designs, the fastening screws are either exposed or a cap must be placed over the screws to hide the screws and maintain an attractive latch. Finally, many automatically locking window latches require a separate catch mounted to a center rail of the window, which takes extra processing in the factory and must be adjusted adequately when installed on the home to ensure proper functionality.

In an attempt to solve at least some of these problems, numerous window latches have been developed. In one design, a window frame extension pushes against a flexible member inside a housing, which in turn pushes against a bolt until the bolt disengages from the housing. When the bolt disengages from the housing, a spring pushes the bolt out of the housing and into a locked position. To unlock the bolt, a user pulls a handle, the handle rotates about a coupling and pulls the bolt from the locked position until the bolt engages the housing.

Such a design is deficient for a number of reasons. For instance, when the window closes, before the bolt can lock the window, the window frame extension must push against an intervening flexible member, which in turn pushes against the bolt to disengage the bolt from the housing. This intervening flexible member may fail or break prematurely from repeated flexing. In addition, because the flexible member is part of the housing, wear on the flexible member may compromise the overall integrity of the housing. Additionally, the handle is separate from the bolt. Having separate parts increases design and manufacturing costs. Furthermore, the screws that attach the latch to the window frame are clearly visible.

Therefore, it can be seen that there is a need for an automatic locking window latch that overcomes the aforementioned deficiencies of conventional window latches. Specifically, there is a need for a window latch that automatically locks the window at the precise moment when the latch communicates with a latch receiver, or latch channel, to avoid damage to the window. There is a need for a window latch that is easy to manipulate to unlock the window. There is a further need for a window latch that will not damage a fixed section of a window while the window is being opened if the window latch is released or not held open. There is a further need for a window latch with a simple operating procedure that eliminates intervening steps and parts for locking and unlocking the latch. There is a further need for a window latch that hides the fasteners without the use of extra parts or screw covers, which may be lost, fall off, or discolor. Finally, there is a need for a window latch that maintains structural integrity and aesthetic appearance while providing all these features.

SUMMARY OF THE INVENTION

The present invention has been developed in response to the present state of the art, and in particular, in response to the problems and needs in the art that have not yet been fully solved by currently available automatically locking window latches. Accordingly, the present invention has been developed to provide an improved automatically locking window latch, thus overcoming many or all of the above-discussed shortcomings in the art.

Specifically, the present invention provides an automatic locking latch for locking a moveable member to a stationary member. The window latch includes a housing, a bolt positioned at least partially within the housing, and a catch slideably engaging the bolt. The catch is configured to retain the bolt in an unlocked position and release the bolt in response to an external force acting against the catch. The bolt may be integrally connected to the handle. The catch may comprise a trigger pin extending through the housing and configured to receive the external force. A chamfered edge of the catch may allow for a smooth and simple transition from a locked position to the unlocked position in addition to moving the bolt into the unlocked position by a transfer of force from a horizontal to a vertical plane. A catch spring pushes the catch between a slide plate of the housing and the bolt to rest in the unlocked position and an external force moves the catch from between the slide plate of the housing and the bolt to rest in a locked position.

In one embodiment, the latch may be configured to attach to a window frame for locking a window. Alternatively, the latch may attach to one member that is to be locked to a second member. The latch requires no strike plate or similar hardware on the second member. In addition, the latch may be attached so that the moveable member moves in various ways in relation to the stationary member. For example, the moveable member may pivot or slide past the stationary member.

Reference throughout this specification to features, advantages, or similar language does not imply that all of the features and advantages that may be realized with the present invention should be, or are, in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Figure 1:
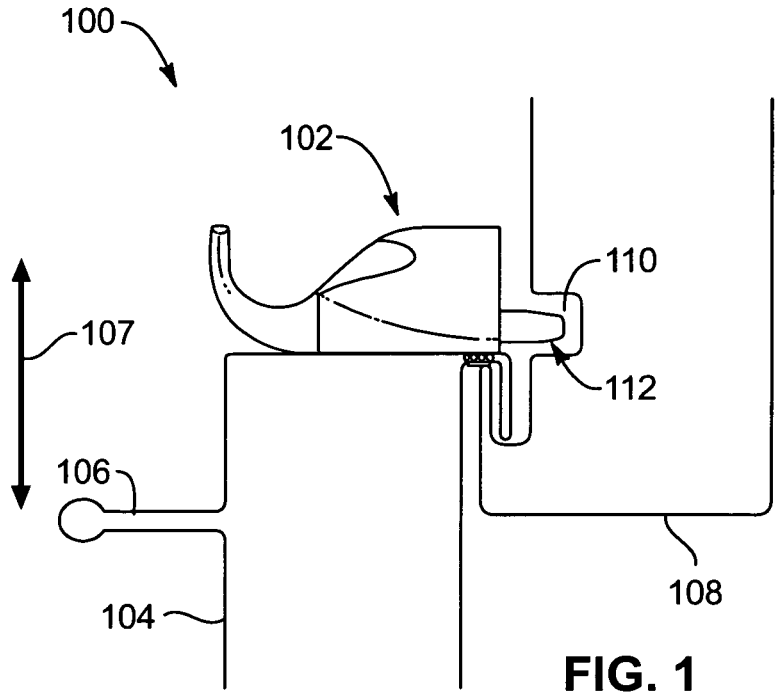
FIG. 1 illustrates one embodiment of a window latch installed on a window.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

FIG. 1 depicts one embodiment of a window latch system 100 according to the present invention. The system 100 includes a window latch 102 fastened to a first window molding 104. A typical molding encloses a panel, such as glass, within the frame of a window or door. The first window molding 104 may include a handle 106 for moving the window molding 104 in a direction indicated by arrow 107.

In this embodiment, the window latch 102 is shown in a locked position, securing the first window molding 104 to a second window molding 108. To secure the window moldings 104, 108, the window latch 102 extends a bolt 112 into an engagement channel 110 of the second window molding 108. Of course, the window latch 102 may alternatively be fastened to the second window molding 108 and the second window molding 108 may also move in the direction of arrow 107 with the engagement channel 110 in the first window molding 104.

Figure 2:
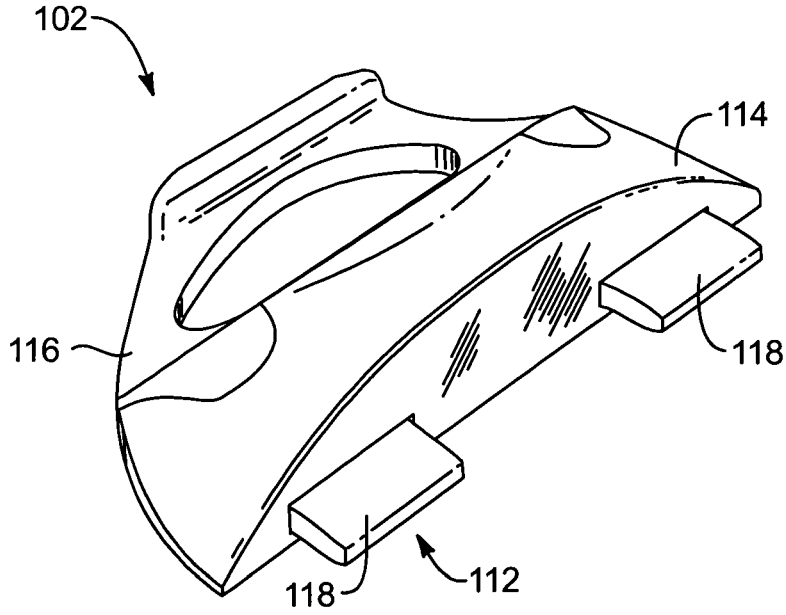
FIG. 2 illustrates a perspective view of one embodiment of a window latch, in a locked position.

FIG. 2 depicts one embodiment of a window latch 102 in a locked position, similar to that shown in FIG. 1. The window latch 102 includes a window latch housing 114 and a bolt 112. Preferably, the bolt 112 is integrated with a handle 116 such that movement of the handle 116 also moves the bolt 112 from a locked position to an unlocked position and vice-versa. Alternatively, the bolt 112 may include a thumb-plate (not shown) or other member connected to the bolt 112 such that pressure on the thumb-plate moves the bolt 112 from a locked position to an unlocked position. In another embodiment, the handle 116 may comprise a simple arm (not shown) that extends from the bolt 112 and the housing 114.

In this embodiment, the bolt 112 comprises a pair of bolt extensions 118. Alternatively the bolt 112 may include any number of bolt extensions 118 depending on the design for the housing 114 and the engagement channel 110 (See FIG. 1). Preferably, the bolt extensions 118 connect to the handle 116 such that when a user pulls the handle 116 away from the housing 114, the extensions 118 retract into the housing 114.

Figure 3:
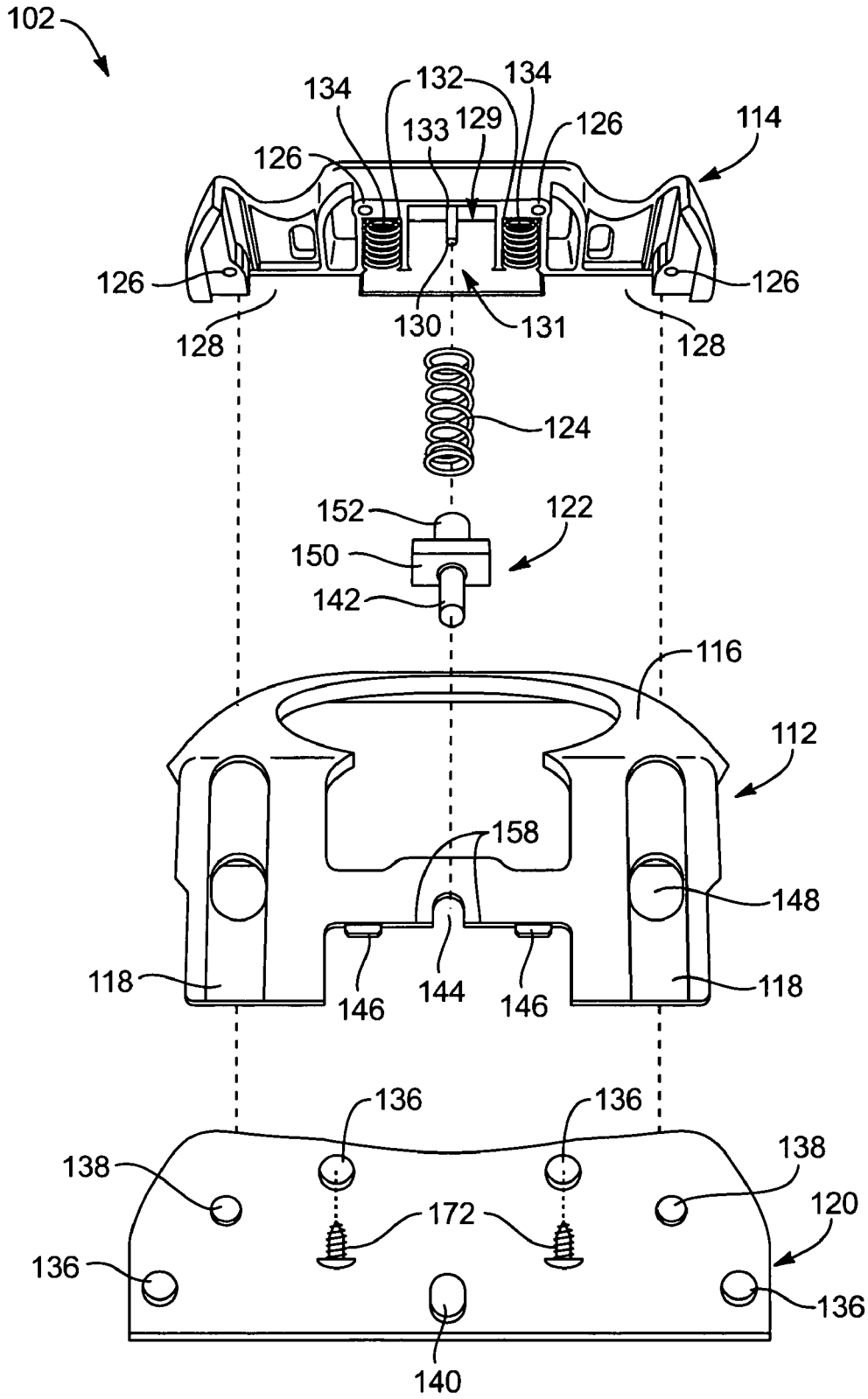
FIG. 3 illustrates an exploded view of one embodiment of a window latch.

FIG. 3 depicts an exploded view of one embodiment of a window latch 102, including a window latch housing 114, a housing baseplate 120, a bolt 112, a catch 122, and a catch spring 124. The housing 114 includes one or more fastener receivers 126 configured to receive a corresponding number of fasteners 172 that pass through the baseplate 120. The housing 114 defines two guides 128 configured to accommodate the bolt extensions 118. The number of guides 128 in the window latch housing 114 preferably corresponds to the number of bolt extensions 118.

Preferably, the housing 114 includes one or more spring cavities 132 each configured to receive a bolt spring 134.

The bolt springs 134 serve to return the bolt 112 from an unlocked position to a locked position, which will be discussed below.

Referring still to FIG. 3, the housing baseplate 120 includes fastener voids 136, mounting voids 138 and a trigger pin guide 140. In the illustrated embodiment, the baseplate 120 has four fastener voids 136 configured to receive fasteners 172 through the baseplate 120 to secure the baseplate 120 to the housing 114. The mounting voids 138 are configured to receive fasteners (not shown) to secure the window latch 102 to the first window molding 104.

The catch 122, in one embodiment, includes a trigger pin 142 configured to extend through the baseplate 120. A trigger pin guide 140 receives, guides, and supports the trigger pin 142 as it traverses the trigger pin guide 140 during locking and unlocking. In one embodiment, the trigger pin guide 140 is oval in shape to receive an oval shaped trigger pin 142. However, those of skill in the art will recognize that the trigger pin guide 140 may be any shape capable of accomplishing its purpose. The catch 122 will be described in more detail below.

In one embodiment, the bolt 112 includes a recessed area 144, a pair of bolt spring stops 146, and a pair of fastener access voids 148. The fastener access voids 148 align with mounting voids 138 in the baseplate 120 when the bolt 112 is in an unlocked position. The alignment of the fastener access voids 148 and the corresponding mounting voids 138 allow mounting screws (not shown) to pass through the fastener access voids 148 and through the corresponding mounting voids 138 to fasten the window latch 102 to the window molding 104, 108. The mounting screws (not shown) do not interfere with the movement of the bolt 112.

Preferably, the bolt spring stops 146 extend substantially perpendicular to the bolt 112 and extend at least partially into the engagement spring cavities 132. The bolt spring stops 146 are configured to engage the bolt springs 134 positioned within the spring cavities 132 of the housing 114. When a user pulls the handle 116, the bolt extensions 118 retract within the housing 114. Simultaneously, the bolt spring stops 146 compress the bolt springs 134 within the spring cavities 132. Upon releasing the retracted bolt 112, the compressed bolt springs 134 cause a bias force against the bolt spring stops 146, which pushes the bolt 112 back into a locked position.

Figure 4:
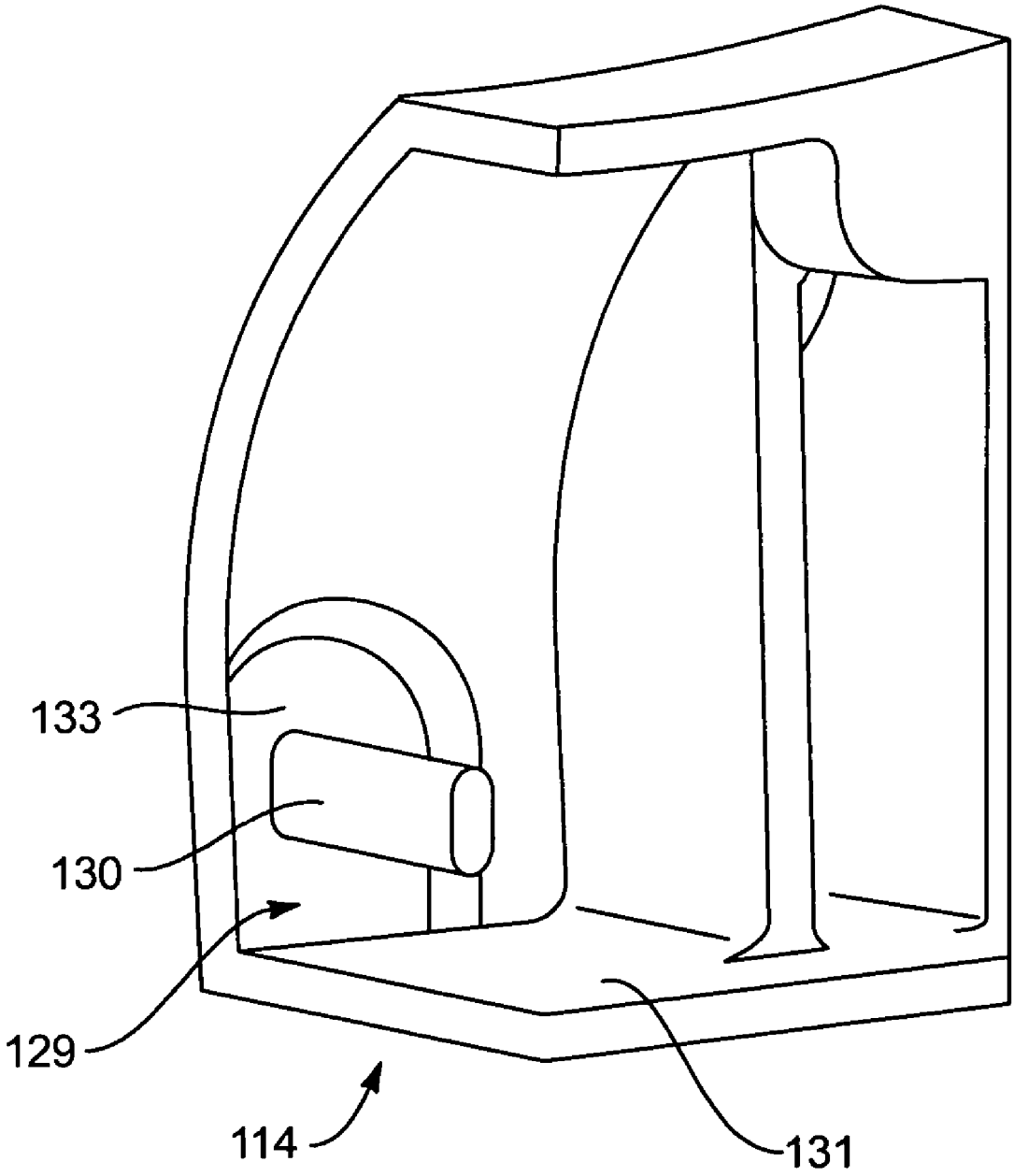
FIG. 4 illustrates one embodiment of the latch housing including the spring well and a guide.

FIG. 4 illustrates a receiving area 129 for receiving the catch 122 within the housing 114. In this embodiment, the receiving area 129 comprises a well 133 with a guide 130 substantially centered within the well 133. The guide 130 extends into the receiving area 129. The guide 130 serves to retain one end of the catch 122 perpendicular to the housing 114. The well 133, in combination with the guide 130, helps maintain the catch spring 124 perpendicular to the housing 114 and concentric to the guide 130.

The interior of the housing 114 includes a slide surface 131 on a wall of the housing 114 located near the guide 130. In another embodiment, the guide may comprise one or more walls (not shown) surrounding the catch 122 to guide the catch 122 as the catch spring 124 compresses.

Figure 5:
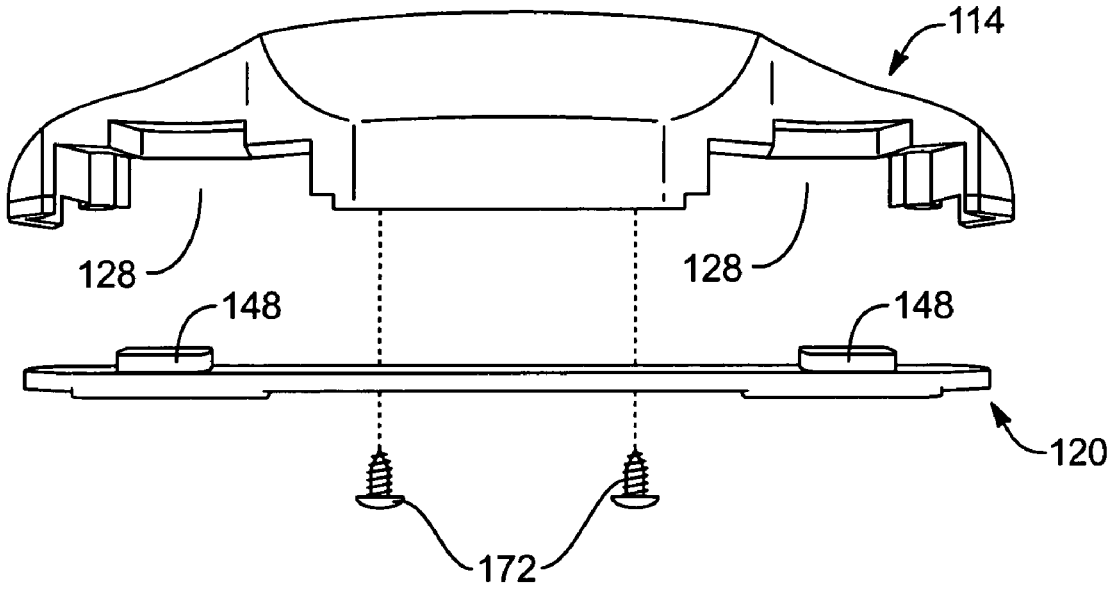
FIG. 5 illustrates an exploded front view of one embodiment of a window latch housing and baseplate.

FIG. 5 illustrates an exploded front view of the window latch housing 114 and baseplate 120. The guides 128 are configured to house the bolt extensions 118 and rails 148 align and guide the bolt 112 over the base plate 120. In one embodiment, the housing 114 may be fastened to the baseplate 120 using fasteners 172. The fasteners 172 may be removable, such as screws. Alternatively, the fasteners may be permanent, such as rivets, welds, glue, or the like.

In a preferred embodiment, the housing 114 is one piece and the baseplate 120 is a separate piece. Alternatively, the housing 114 and baseplate 120 may be formed by a plurality of sections that are suitably fastened. Those of skill in the art will recognize that a housing 114 and baseplate 120 made from a plurality of sections are well within the scope of the present invention.

Figure 6A:
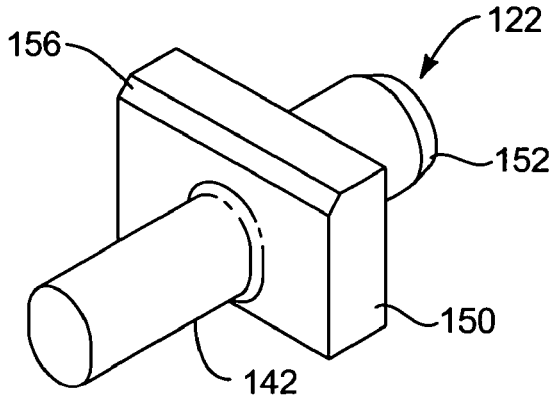
FIG. 6A is a perspective view of one embodiment of a catch.
Figure 6B:
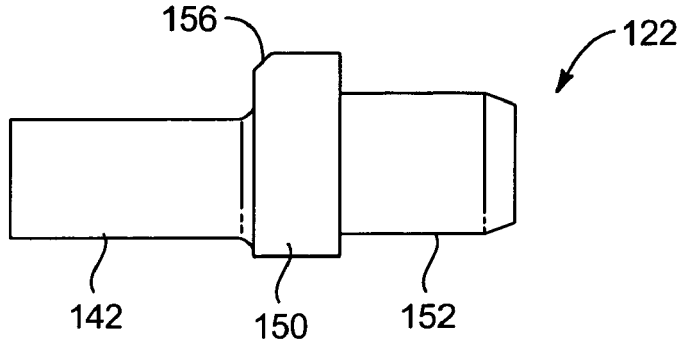
FIG. 6B is a side view of one embodiment of a catch.
Figure 6C:
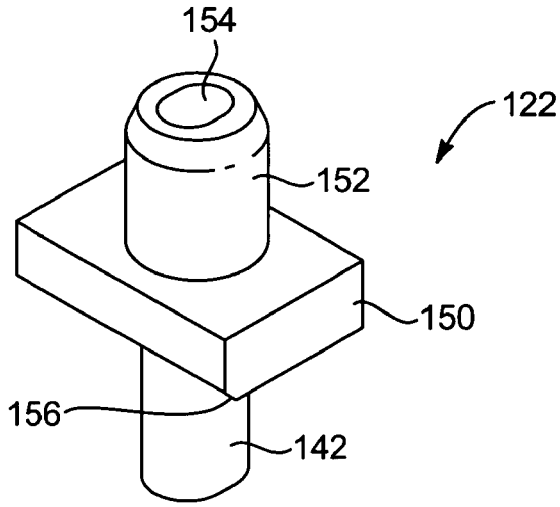
FIG. 6C is a front perspective view of one embodiment of a catch.

FIGS. 6A, 6B, and 6C illustrate various views of one embodiment of the catch 122. Preferably, the catch 122 includes a rectangular catch body 150 with an optional chamfered edge 156, a spring guide 152, and a trigger pin 142. Alternatively, the catch body 150, spring guide 152, and trigger pin 142 may comprise other shapes and sizes.

In this embodiment, the spring guide 152 is cylindrical in shape and configured to receive the catch spring 124 (See FIG. 3). An optional rounded tip of the spring guide 152 prevents the catch spring 124 from snagging as the catch spring 124 is compressed and released. The cylindrical shape of the spring guide 152 allows the catch spring 124 to contract and retract smoothly. In a preferred embodiment, the catch spring 124 is a coil spring In one embodiment, the catch body 150, spring guide 152, and trigger pin 142 are all formed from a single material, such as plastic, metal, or ceramic. Alternatively, the catch body 150, spring guide 152, and trigger pin 142 may be formed of distinct materials properly connected to provide the functionality described herein.

Preferably, a guide cavity 154 is formed within the spring guide 152 of the catch 122. In one embodiment, the guide cavity 154 is configured to receive a guide 130 (see FIG. 4) that extends from the interior of the housing 114. In this manner, the guide 130 provides a slide guide for the catch 122.

In another embodiment, the guide cavity 154 is configured to receive the catch spring 124 and the guide. The catch spring 124 may contract and expand as the guide cavity moves over the guide 130. In this manner, alternative configurations for coupling the catch 122 and the catch spring 124 may be used, each within the scope of the present invention those of skill in the art will appreciate. For example, in one embodiment, the catch spring 124 comprises a torsion spring with one end wedged against a back wall of the housing and the other end within a recess (not shown) of the catch body 150. In such an embodiment, the spring guide 152 may comprise a tab that holds one end of the torsion spring.

In the illustrated embodiment, the trigger pin 142 is configured to protrude outwardly from the housing 114 and through the base plate 120 (See FIG. 3) to receive an external force to move the catch 122. Those of skill in the art will appreciate that the trigger pin 142 may be any length. In another embodiment, the catch 122 may be configured without a trigger pin 122. Specifically, the window frame 108 may comprise an extension (not shown) configured to reach into the housing 114 through the base plate 120 to push directly against the catch 122 when the window frame 108 closes. This external force pushing directly against the catch 122 moves the catch 122 from between the slide plate 131 (See FIG. 4) and the bolt 112 (See FIG. 3). In another embodiment, the trigger pin 142 may be any shape. In another embodiment, the catch 122 may comprise a plurality of trigger pins 142.

Figure 7A:
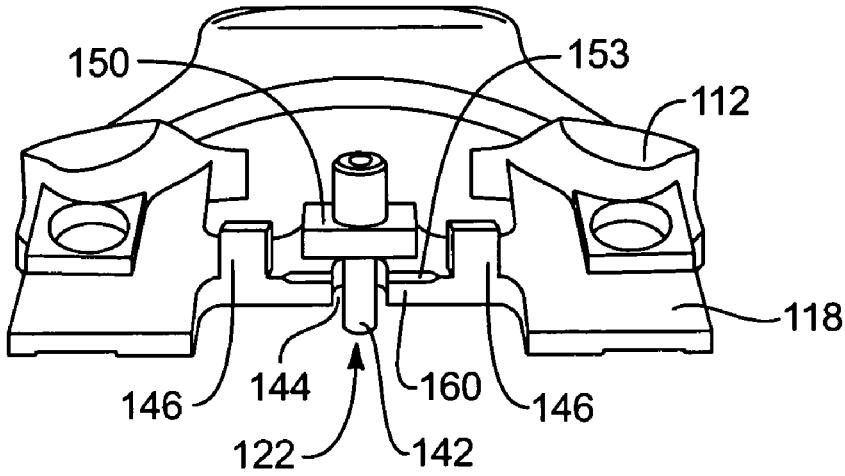
FIG. 7A illustrates a perspective view of one embodiment of a bolt in a locked position and disengaged from a catch.

FIG. 7A illustrates the catch 122 in relation to the bolt 112 when the bolt 112 is in a locked position. In a locked position, the catch spring 124 (See FIG. 3) presses the catch 122 against the bolt 112. The trigger pin 142 may extend through the recessed area 144. The bolt extensions 118 extend from the housing 114 (See FIG. 3)) to lock the windows (See FIG. 1).

Figure 7B:
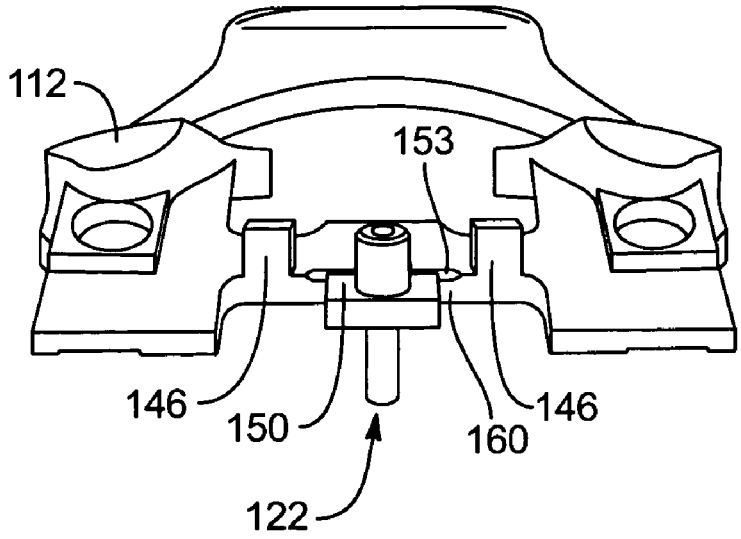
FIG. 7B illustrates a perspective view of one embodiment of a bolt in an unlocked position and engaged by a catch.

FIG. 7B illustrates the bolt 112 in an unlocked position. The catch 122 engages a contact surface 160 on the bolt and sits between the bolt 112 and the housing 114 (See FIG. 3). The location of the catch body 150 between the bolt 112 and the slide plate 131 of the housing 114 prevents the bolt 112 from advancing against the window pane and/or the window molding 108. Bolt springs 134 (See FIG. 3) press against the bolt spring stops 146 biasing the bolt 112 against the catch 122. In this manner, the window latch 102 remains in the unlocked position until the catch body 150 moves from between the bolt 112 and the slide plate 131 of the housing 114.

In a preferred embodiment, the contact surface 160 also includes a chamfered edge 153. The chamfered edge 156 (See FIG. 6A) of the catch 122 and the chamfered edge 153 of the contact surface 160 slideably engage to facilitate movement of the catch 122 as it moves from a locked position to an unlocked position, and vice versa. The angle of the chamfered edge 156 of the catch 122 and the chamfered edge 153 of the contact surface 160 may range between about 10 to about 75 degrees each. Naturally, a smaller chamfer angle reduces the amount of force necessary to move the catch 122 over the bolt 112. A preferred chamfer angle is about 45 degrees each.

Figure 8:
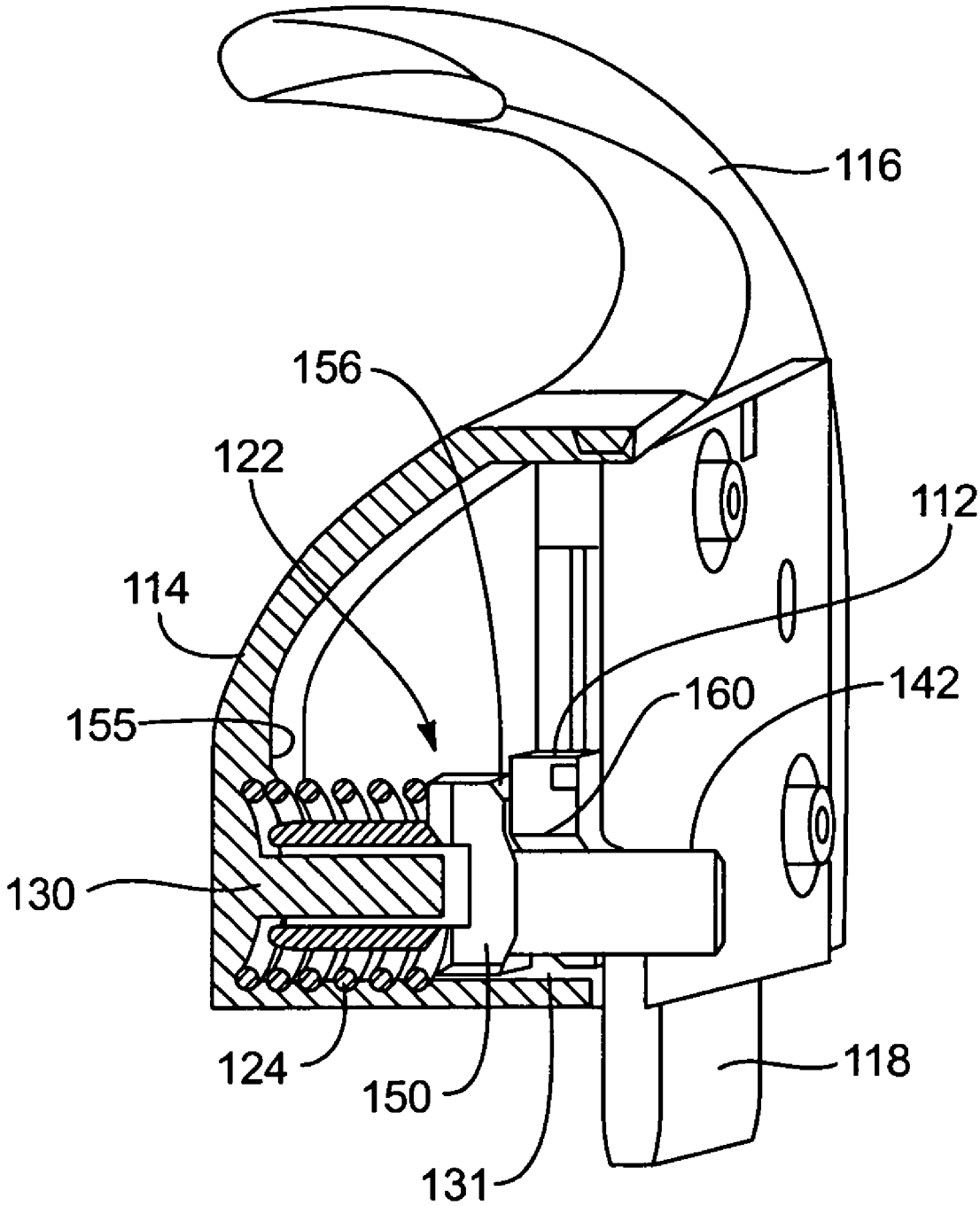
FIG. 8 is a cross-sectional view of a window latch illustrating the catch mechanism.

FIG. 8 illustrates a cross-sectional side view of the window latch 102 in the locked position. The external force acting against the trigger pin 142 removes the catch 122 from between the bolt 112 and the slide plate 131 of the housing 114 to the current position of the catch illustrated in FIG. 8. Alternatively, an external force may act directly against the catch body 150 to remove the catch 122 from between the bolt 112 and the slide plate 131 of the housing 114. For example, a rod (not shown) from a window molding may project into the housing 114 to function as a trigger pin 142, and force the catch 122 out from between the bolt 112 and slide surface 131. The catch 122 is configured to traverse the guide 130 and move substantially perpendicular to a back wall 155 of the housing 114 against a bias force of the catch spring 124.

With the catch body 150 removed, the compressed bolt springs 134 (FIG. 3) move the bolt 112 into the locked position with the extensions 118 extending outward from the housing 114. The catch spring 124 presses the catch 122 against the bolt 112.

Figure 9A:
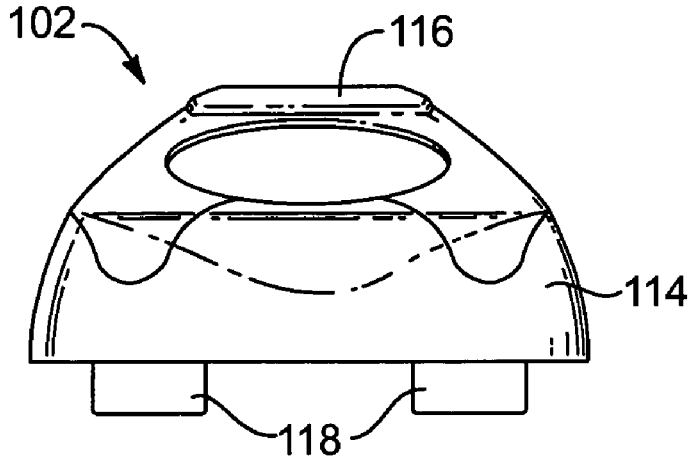
FIG. 9A illustrates a top view of one embodiment of a window latch, in a locked position.
Figure 9B:
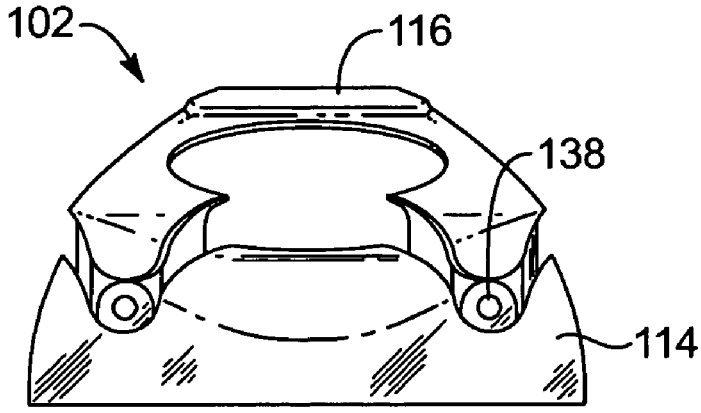
FIG. 9B illustrates a top view of one embodiment of a window latch, in an unlocked position.

FIGS. 9A and 9B illustrate various perspectives of one embodiment of the window latch 102, respectively, in the locked and unlocked positions. FIG. 9A illustrates a top view of the window latch 102, including the handle 116, the housing 114, and the bolt extensions 118, in the locked position. The mounting voids 138 (See FIG. 3) and fastener access voids 148 (See FIG. 3) are not visible in the locked position.

Similarly, FIG. 9B illustrates a top view of the window latch 102 in the unlocked position, having the handle 116 drawn from the housing 114. The bolt extensions 118 (See FIG. 3) have retracted within the housing 114. Preferably, the bolt extensions 118 fully retract within the housing 114. Alternatively, the bolt extensions 118 may partially retract. Additionally, in the unlocked position, the mounting voids 138 are exposed to allow access to mounting fasteners (not shown).

Figure 10:
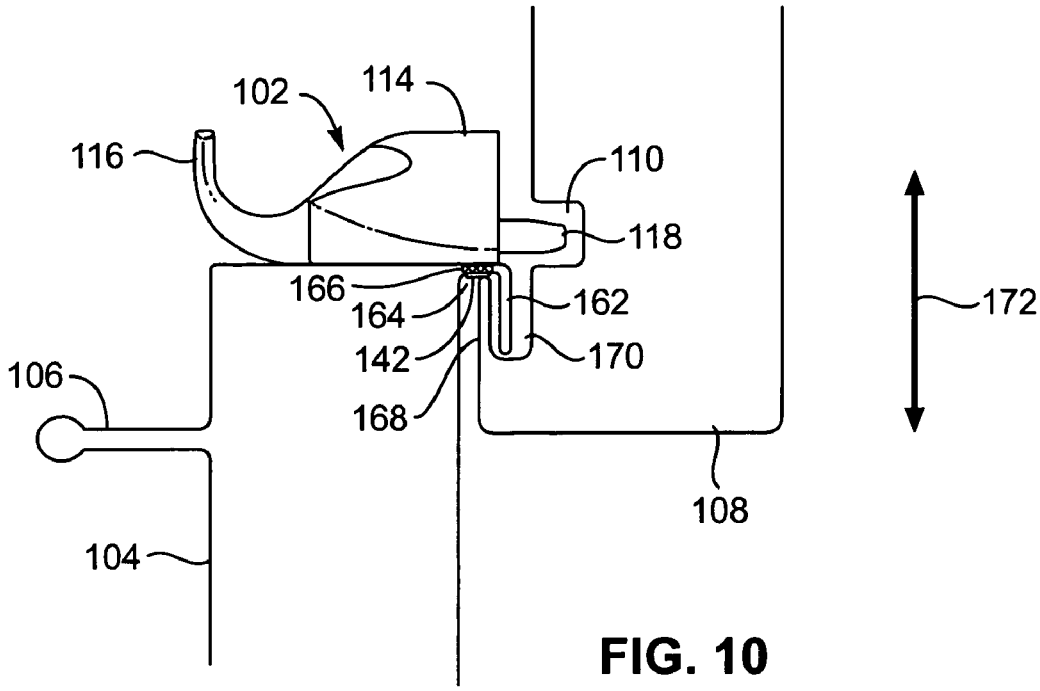
FIG. 10 illustrates one embodiment of a locked window latch installed on a window frame.

FIG. 10 illustrates one embodiment of a window latch 102 mounted on a first interlocking window molding 104. The window latch 102 is in a locked position such that the bolt extensions 118 extend into the engagement channel 110, preventing the window moldings 104, 108 from moving passed each other.

The first molding 104 may include a first interlocking leg 162 that may run the width of the window molding 104 and defines a first interlocking channel 164. The window handle 106 facilitates movement of the first window molding 104 when the window latch 102 is in an unlocked position. Preferably, the first interlocking channel 164 includes a trigger pin guide 166, preferably a hole, aligned with a second interlocking leg 168 of the second window molding 108.

The illustrated second interlocking window molding 108 has a second interlocking leg 168 that may run the width of the second window molding 108 and define a second interlocking channel 170. The second molding 108 may also include an engagement channel 110. The engagement channel 110 may run the width of the molding 108. Alternatively, the engagement channel 110 may run only the width of the window latch 102. In a further embodiment, the second molding 108 may include more than one engagement channel 110 each sized and configured according to the number and arrangement of bolt extensions 118 used in the window latch 102.

FIG. 10 also illustrates the trigger pin 142 within the trigger pin guide 166 of the first molding 104, extending slightly into the first interlocking channel 164. In this locked position, the catch spring 124 presses the catch body 150 against the bolt 112 as discussed in relation to FIG. 7A. Alternatively, in the absence of a trigger pin 142, the second interlocking leg 168 may comprise a trigger pin extension (not shown) extending upward through the trigger pin guide 166 and into the housing. The interlocking leg 168 may be long enough to enter the housing 114.

Figure 11:
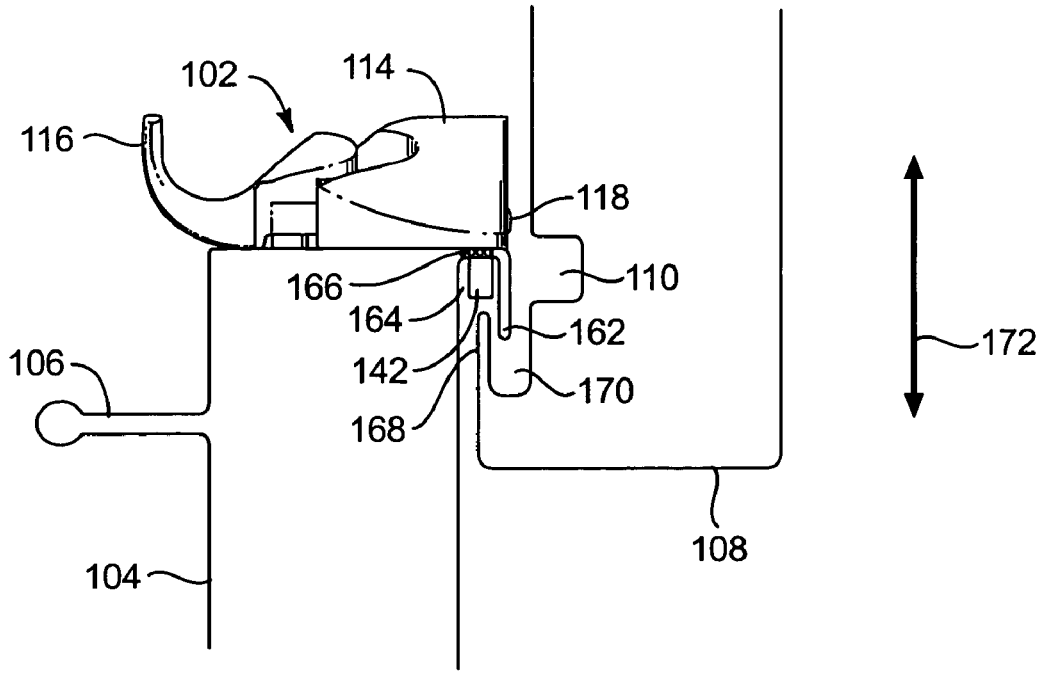
FIG. 11 illustrates one embodiment of an unlocked window latch installed on a window frame.

FIG. 11 illustrates one embodiment of the window latch 102 in an unlocked position. Specifically, the handle 116 is withdrawn from the housing 114 and the bolt extensions 118 at least partially retract within the housing 114. As the bolt extensions 118 are retracted they disengage from the engagement channel 110, allowing the first window molding 104 to move freely in a vertical direction 172.

In this unlocked position, the catch spring 124 forces the catch 122 between the bolt 112 and the slide surface 131 of the housing 114 so as to retain the bolt extensions 118 substantially within the housing 114 as discussed in relation to FIG. 7B. With the window latch 102 in this unlocked position, the first window molding 104 may be moved vertically in the direction of arrow 172. With the bolt extensions 118 in the unlocked position, the bolt extensions 118 do not contact the second window molding 108 or glass.

The bolt extensions 118 in one embodiment are automatically extended into the engagement channel 110 as the window moldings 104, 108 move into a closed position. Specifically, as the first window molding 104 moves into the interlocked position with the second window molding 108, the trigger pin 142 contacts the second interlocking leg 168 of the second window molding 108. The trigger pin 142 consequently moves the catch body 150, against the compressed force of the catch spring 124, from between the bolt 112 and the slide surface 131 of the housing 114. The bolt springs 134 subsequently move the bolt 112 such that the bolt extensions 118 extend into the engagement channel 110 and secure the window moldings 104, 108 into a locked position.

It is understood that the above-described arrangements are only illustrative of the application of the principles of the present invention. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the present invention describes the use of the latch on windows, it is envisioned that this latch may be fastened to a variety of other devices, such as drawers, doors, panels, gates, etc.

Thus, while the present invention has been fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A latch for locking a moveable member to a stationary member, the latch comprising:

a housing;

a bolt positioned at least partially within the housing;

a catch, slideably engaging the bolt, the catch configured to retain the bolt in an unlocked position and release the bolt in response to an external force acting against the catch, such that the bolt operably engages the moveable member or the stationary member;

wherein the catch further comprises a trigger pin configured such that the external force acts directly against the trigger pin to move the catch; and a handle, integrally connected to the bolt, the handle configured to retract the bolt into the housing in response to a force that removes the handle from the housing; and at least one bolt spring positioned within the housing and configured to move the bolt into a locked position.

2. The latch according to claim 1, wherein the latch is fastened to the moveable member, or the stationary member, each of the members selected from a group consisting of a window, a drawer, a desk, a table, and a door.

3. The latch according to claim 1, further comprising a baseplate connected to the housing and configured such that the trigger pin extends through the baseplate.

4. A latch for locking a moveable member to a stationary member, the latch comprising:

a housing;

a bolt positioned at least partially within the housing;

a catch, slideably engaging the bolt, the catch configured to retain the bolt in an unlocked position and release the bolt in response to an external force acting against the catch, such that the bolt operably engages the moveable member or the stationary member;

wherein the catch further comprises a trigger pin configured such that the external force acts directly against the trigger pin to move the catch;

a handle, integrally connected to the bolt, the handle configured to retract the bolt into the housing in response to a force that removes the handle from the housing; and a catch spring positioned between the housing and the catch, the catch spring configured to position the catch between the bolt and a slide plate of the housing in response to the bolt moving toward the unlocked position.

5. A latch for locking a moveable member to a stationary member, the latch comprising:

a housing;

a bolt positioned at least partially within the housing;

a catch, slideably engaging the bolt, the catch configured to retain the bolt in an unlocked position and release the bolt in response to an external force acting against the catch, such that the bolt operably engages the moveable member or the stationary member;

wherein the catch further comprises a trigger pin configured such that the external force acts directly against the trigger pin to move the catch;

a handle, integrally connected to the bolt, the handle configured to retract the bolt into the housing in response to a force that removes the handle from the housing; and wherein the latch further comprises:

a first chamfered edge on the catch; and a second chamfered edge on the bolt, the second chamfered edge slideably engaging the first chamfered edge as the bolt moves past the catch.

6. The latch according to claim 5, wherein the first and second chamfered edges are angled at approximately 45 degrees each.

7. The latch according to claim 5, wherein the first and second chamfered edges independently angle within a range of between 10 degrees and 75 degrees each.

8. A window latch for locking a window, the window latch comprising:

a housing;

a bolt, positioned at least partially within the housing, the bolt configured to secure a movable window in a locked position;

a catch slideably engaging the bolt, the catch configured to retain the bolt in an unlocked position and release the bolt in response to force applied through a trigger pin, such that the bolt secures the movable window in the locked position; and a catch spring positioned between a back wall of the housing and the catch, the catch spring configured to position the catch between the bolt and a slide plate transverse to a back wall of the housing when the bolt is in an unlocked position.

9. The window latch according to claim 8, wherein the trigger pin is integrated with the catch.

10. The window latch according to claim 8, wherein the housing further comprises a guide connected to the housing, the guide configured to ensure substantially perpendicular movement of the catch with respect to a back wall of the housing.

11. The window latch according to claim 8, wherein the bolt comprises a recessed area, the recessed area configured to permit free passage of the trigger pin.

12. A window latch for locking a window, the window latch comprising:

a housing configured to connect to a window frame with at least one fastener;

a handle, movably connected to the housing, the handle configured to cover the fastener when the handle is in a locked position and allow access to the fastener when the handle is in an unlocked position;

a bolt integrated with the handle, the bolt positioned at least partially within the housing; and a catch, slideably engaging the bolt, the catch configured to retain the bolt in an unlocked position and release the bolt in response to an external force against the catch; and wherein the bolt comprises a pair of bolt extensions configured to lock the window in a closed position.

13. The window latch according to claim 12, wherein the latch further comprises a trigger pin connected to the catch, and wherein the external force acts directly against the trigger pin to move the catch.

14. The window latch according to claim 12, further comprising:

a catch spring positioned between a back wall of the housing and the catch;

a first chamfered edge on the catch;

a second chamfered edge on the bolt;

at least one bolt spring, within a spring cavity within the housing, the bolt spring configured to push a pair of bolt extensions from the housing to lock the window in a locked position; and wherein a bias force of the catch spring drives the catch between the bolt and a slide plate transverse to a back wall of the housing in response to the handle being drawn from the housing to hold the bolt in an unlocked position.

* * * * *